US007055653B2

(12) United States Patent
Hamada

(10) Patent No.: US 7,055,653 B2
(45) Date of Patent: Jun. 6, 2006

(54) ESCAPE DEVICE

(76) Inventor: Yoshio Hamada, 132-3, Kaya-machi 6-chome, Matsuyama City, Ehime-ken (JP)

( * ) Notice: Subject to any disclaimer, the term of this patent is extended or adjusted under 35 U.S.C. 154(b) by 71 days.

(21) Appl. No.: 10/827,840

(22) Filed: Apr. 20, 2004

(65) Prior Publication Data

US 2005/0126857 A1 Jun. 16, 2005

(30) Foreign Application Priority Data

Dec. 11, 2003 (JP) ..... 2003-436542

(51) Int. Cl.
*A62B 1/00* (2006.01)

(52) U.S. Cl. ..... 182/231; 182/72; 182/193

(58) Field of Classification Search ..... 182/5–7, 182/191–193, 231, 235, 236, 240, 71, 72
See application file for complete search history.

(56) References Cited

U.S. PATENT DOCUMENTS 482,813 A * 9/1892 Schwarz ..... 182/193
554,587 A * 2/1896 Evans ..... 182/192
656,507 A * 8/1900 Brown ..... 182/236
839,974 A * 1/1907 Warfield ..... 182/235
2,544,964 A * 3/1951 Phelan ..... 182/193
2,557,483 A * 6/1951 Tarasiuk ..... 188/64

FOREIGN PATENT DOCUMENTS

JP 07-509382 10/1995
JP 10-052511 2/1998
JP 10-248945 9/1998

* cited by examiner

*Primary Examiner*—Alvin Chin-Shue
(74) *Attorney, Agent, or Firm*—Knobbe, Martens, Olson & Bear LLP

(57) ABSTRACT

A shaft with a gear and a small-diameter drum mounted and a different shaft with a gear and a large-diameter drum mounted are axially mounted in a rotatable condition across the inside of a housing. The gears are engaged with each other. A case has a horizontally long cavity part being open to one side, and rope insertion holes. The cavity part has, in a movable condition, an adjusting tool between an energizing means and a restricting means. The adjusting tool has a rope insertion hole. The rope is wound around the small-diameter drum and the large-diameter drum respectively in the same direction. The externally let-off rope obtained through an upper rope let-off hole has, at an upper end, a hook. The externally let-off rope obtained through a lower rope let-off hole is in a hanging-down condition resulting from insertion of the rope into the above rope insertion holes.

7 Claims, 4 Drawing Sheets

ESCAPE DEVICE

BACKGROUND OF THE INVENTION

1. Field of the Invention

This invention relates to an escape device used in the occurrence of a fire and the like.

2. Description of the Related Art

Conventionally available escapes of this type include an escape ladder and a cylindrical-shaped escape slide respectively formed with a bendable and flame-retarding member. The above escape ladder and escape slide are effective in allowing a user upstairs to make escape from an upper story of a building to the ground by letting down a lower end of the above escape ladder or escape slide from an upstairs window frame, with an upper end thereof fixedly mounted to the above window frame.

However, the above escape ladder needs to be used in such a manner that the user climbs backward down the ladder with one's foot on steps of the ladder, thereby providing a disadvantage of being not suited to crippled or weakened invalids or the aged. The above escape slide needs to be used in such a manner that the user slides down in a sitting posture with one's legs stretching within a cylindrical-shaped escape instrument, so that an increase in sliding distance increases acceleration, thereby providing a disadvantage of being in danger. To eliminate the above disadvantages, the inventor of the present application invented an emergency lifting apparatus, which is effective in allowing a user to make escape to the ground safely by carrying out a handle operation for letting-off of a wire rope from either of upper and lower drums and winding of the wire rope, with a gondola integrally mounted to a lowering machine housing with a handle, and a patent on the above emergency lifting apparatus was obtained (See the following Patent document 1). The above emergency lifting apparatus described in the Patent document 1 has the gondola being capable of accommodating persons, thereby providing an advantage of enabling escape of more than one person to be attained at a time.

Alternatively, there is also proposed an urgent escape apparatus, which enables escape to be attained in isolation from flames and smoke by incorporating, in a shroud chute at the inside or outside of a building in an independent manner for each house, a prefabricated scaffolding-shaped structure adapted to support a module obtained by incorporating a cable pulley and a control mechanism, with the above structure fixed to the ground using a big nail and a stretched net and also connected to a hydraulic motor through a gear and a gear box, and also with a motor hoisting rate determined using a control means (See the following Patent document 2, for instance). Alternatively, there is also proposed a non-power circulating-type building emergency apparatus having an air supply equipment and a lighting equipment (See the following Patent document 3, for instance).

[Patent document 1] Japanese Patent Publication No. 3277246

[Patent document 2] Japanese Patent Publication (Toku-hyo) No. 07-509382

[Patent document 3] Japanese Patent Laid-open No. 10-248945

The inventions as described in the above Patent documents 1 and 3, however, require a large-scaled apparatus, although providing advantages of enabling escape of more than one person to be attained safely at a time and of being economical because of no need for any drive device such as a motor. The invention as described in the above Patent document 2 provides disadvantages of being not suited to a person having trouble in the leg or the aged since the user needs to pass through the shroud chute for descending to the ground, of causing an increase in cost because of a need for a large number of components inclusive of the control device and the like, of requiring fixing or the like of the structure to the ground before escape, and of taking too much time for set-up of the apparatus to meet the necessity for momentary escape.

SUMMARY OF THE INVENTION

It is an object of the present invention to provide an escape device for individual use, more specifically, an escape device, which is effective in allowing an individual person to make escape to a lower story of a building or to the ground safely at a time, while providing advantages of being extremely easy to attach to the building, and of being lightweight enough to permit the aged or female users to carry usually in a compacted form when not used.

An escape device according to the present invention comprises a speed decreasing gear obtained by axially mounting, in a rotatable condition, a shaft having a gear and a small-diameter drum and a different shaft having a gear and a large-diameter drum across a space between oppositely facing inside walls of a housing such that the above shafts have a vertically parallel positional relationship, with the above gears engaged with each other; a rope traveling stopping device having a case having a horizontally long cavity part being open to one side, and vertically extending-through rope insertion holes being open to and communicating with the cavity part, wherein the cavity part has therein an adjusting tool having a rope insertion hole being capable of communicating with the above rope insertion holes of the case so as to permit the adjusting tool to be moved along the cavity part in a longitudinal direction, and the above adjusting tool is adapted to adjust a traveling distance of a rope with a means of restricting a position of the adjusting tool from an opening side of the cavity part and a means of energizing the adjusting tool toward the opening of the cavity part; a belt adapted to interconnect the speed decreasing gear and the rope traveling stopping device and having a size enough to encircle the body of a user; and the rope; wherein the rope has, at an upper end thereof, a means of attaching the rope to the building, while downwardly drawing-out of the rope through a lower surface of the housing is effected, with the rope wound around the small-diameter drum and the large-diameter drum respectively, to ensure that a hanging-down condition of the rope is obtained through insertion of the rope into the rope insertion holes of the case and the adjusting tool.

The escape device of the present invention brings traveling of the rope into a stop with a simple mechanism without requiring any drive means such as a motor, thereby providing an advantage of enabling the user to adjust a descending speed in the course of descending.

The escape device of the present invention needs only attaching or the like of the upper end of the rope to a pipe-shaped handrail, for instance, before use of the escape device, thereby also providing an advantage of enabling the user to make escape quickly.

The escape device of the present invention is realized with a small number of components and is also lightweight, thereby also providing an advantage of being handy to carry usually, with the escape device put in a hand bag or the like, to ensure that escape from a fire and the like happened to the user on the way is enabled by user's own efforts without a need for other's assistance.

The escape device of the present invention has the rope that is hanging down from the speed decreasing gear, in which the gears provided to be coaxial with the upper and lower drums having different diameters are engaged with each other, with the rope wound around the above drums. Thus, the above escape device enables the user to make escape by descending safely with the minimum number of components without requiring any energy such as electric power in such a manner as to connect the speed decreasing gear and the rope traveling stopping device through the belt, while drawing out the rope downwards through the opening of the lower rope insertion hole of the case of the rope traveling stopping device after insertion of the rope into the rope insertion hole of the adjusting tool placed between the energizing means and the restricting means in the cavity part of the above case and also into the rope insertion holes of the above case.

BRIEF DESCRIPTION OF THE DRAWINGS

The foregoing and other objects and features of the invention will become more apparent in the following description of a presently preferred embodiment of the invention in conjunction with the accompanying drawings, in which.

DETAILED DESCRIPTION OF THE PREFERRED EMBODIMENT

Figure 1:
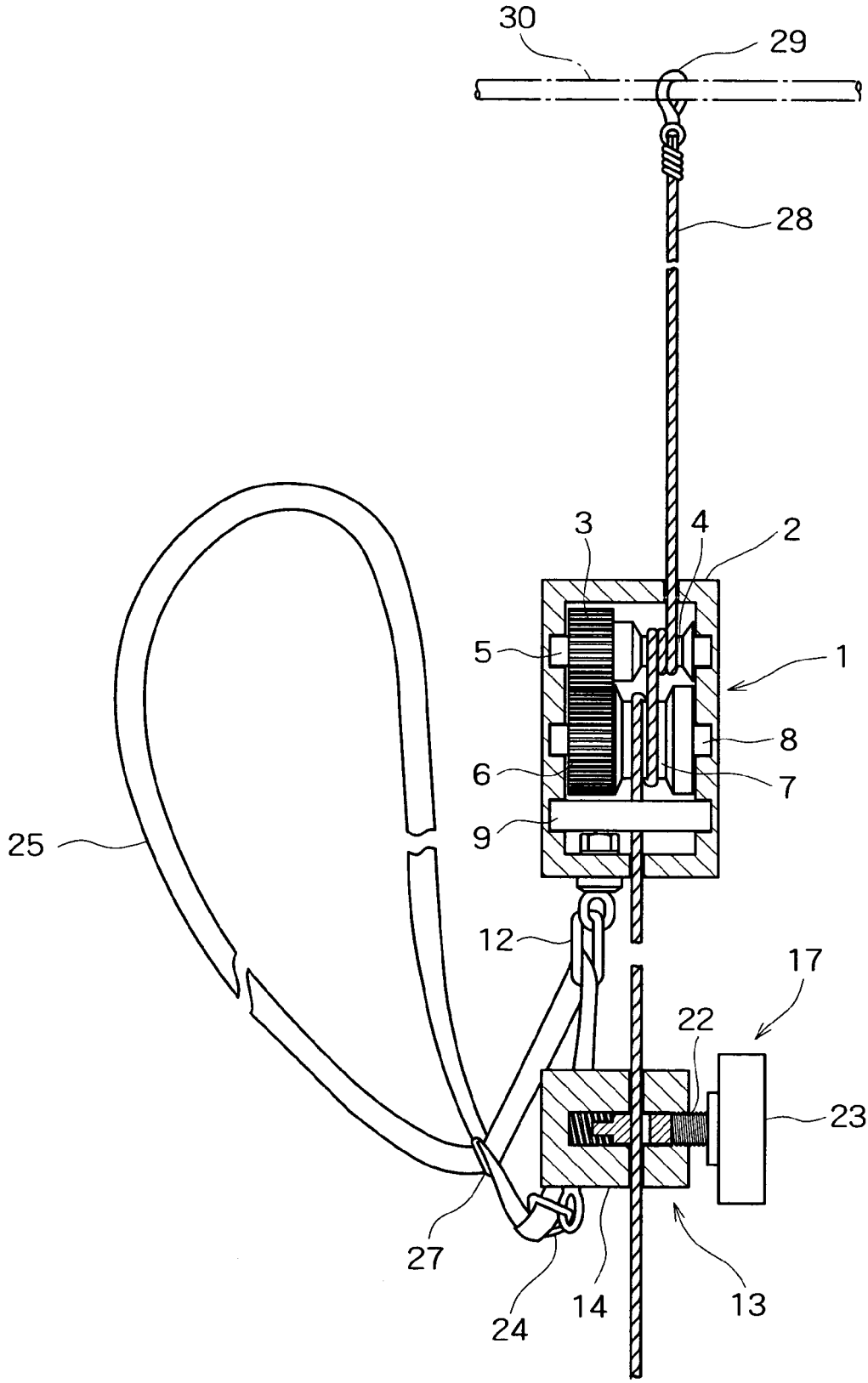
FIG. 1 is schematic view showing a constitution of an escape device with a housing and a case omitted.
Figure 2:
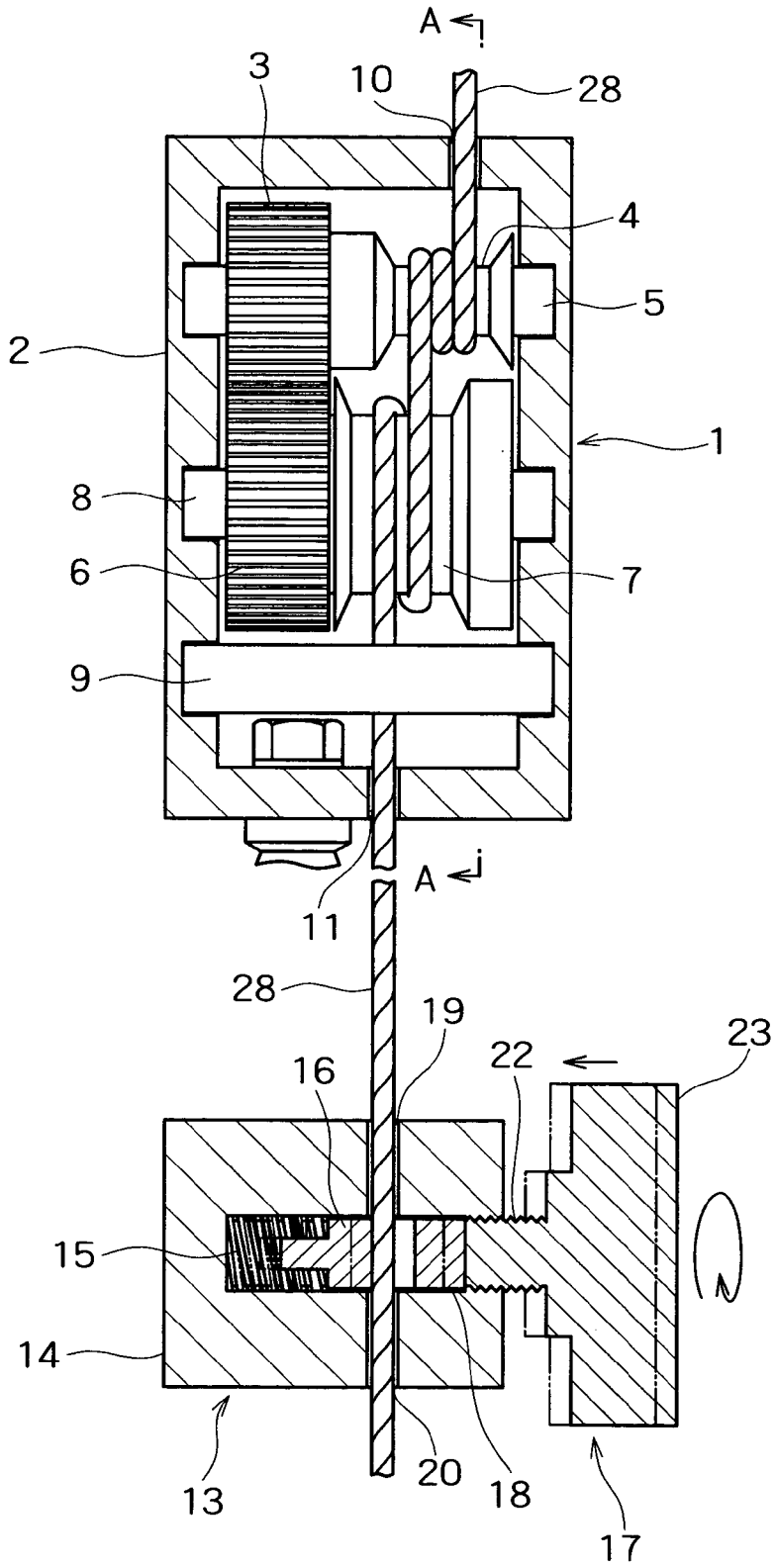
FIG. 2 is an enlarged view showing a constitution of a speed decreasing gear and that of a rope traveling stopping device.
Figure 3:
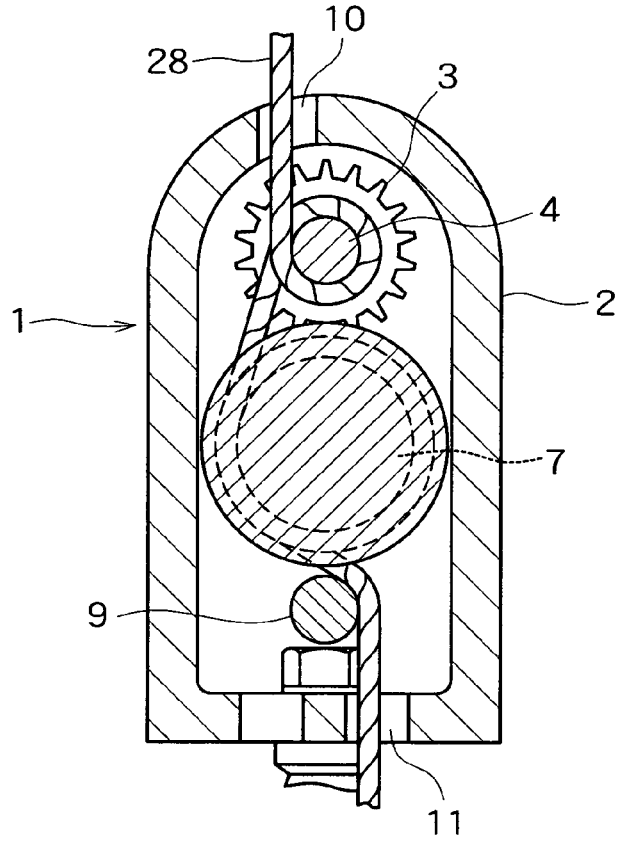
FIG. 3 is a sectional view taken along line A—A in FIG. 2.

In FIGS. 1 to 6, reference numeral 1 denotes the entirety of a speed decreasing gear, which has a longitudinally long box-shaped housing 2 having, at an inside thereof, a shaft 5 with a gear 3 and a small-diameter drum 4 fixedly mounted, a shaft 8 with a gear 6 and a large-diameter drum 7 fixedly mounted, and a guide rod 9. More specifically, the shaft 5 with the gear 3 and the small-diameter drum 4 fixedly mounted are mounted axially in a rotatable condition across a space between oppositely facing inside walls of an upper part of the housing 2. The shaft 8 is mounted axially across a space between oppositely facing inside walls of the housing 2 so as to be in parallel with the shaft 5 and at a position below the shaft 5 in a condition where the gear 6 and the large-diameter drum 7 are mounted fixedly to the shaft 8 to ensure that the gear 6 is engaged with the gear 3. The gear 3 and the gear 6 are sized to be equal in diameter. The guide rod 9 is mounted across a space between oppositely facing inside walls of the housing 2 so as to be at a position below the shaft 8. The housing 2 has, in upper and lower walls, rope let-off holes 10, 11, respectively. A belt mount ring 12 is mounted to the outside of the lower wall of the housing 2.

A rope traveling stopping device denoted by reference numeral 13 in the Figures is composed of a case 14, an energizing means 15 and an adjusting tool 16 that are both housed in the case 14, and a restricting means 17 for restricting a position of the adjusting tool 16. The case 14 has, at an inside thereof, a horizontally long cavity part 18 that is open to one side. The case 14 also has rope insertion holes 19, 20 that are open to and communicate with the cavity part 18, specifically, extend through the case so as to be vertically in alignment. The cavity part 18 has therein the adjusting tool 16 having a rope insertion hole 21 so as to permit the adjusting tool 16 to be moved in a sliding manner in a longitudinal direction of the cavity part 18. The energizing means 15 is formed with a coiled spring that is adapted to energize the adjusting tool 16 toward an opening of the cavity part 18. The restricting means 17 is composed of an external thread 22 fitted by screwing to an internal thread formed at an opening end of the cavity part 18, and a handle 23. The restricting means 17 is adapted to restrict the position of the adjusting tool 16 within the cavity part 18 by an operation of the handle 23. A belt mount ring 24 is mounted to a lower surface side of an outside wall of the case 14. A belt 25 is formed in the shape of a ring adaptable to encircle the body of a user 26. The belt 25 is mounted in such a manner as to be inserted into the belt mount rings 12, 24. Reference numeral 27 denotes a clip that is adapted to clip a part of the belt 25 in an overlapped form so as to permit adjustment of the size of the belt 25 to be effected.

Within the housing 2, a rope 28 is wound around the large-diameter drum 7 by one turn, and also around the small-diameter drum 4 by two turns in the same direction as winding around the large-diameter drum 7. A hook 29 is mounted to an upper end of the externally let-off rope 28 obtained through the rope let-off hole 10, with the rope wound around the small-diameter drum 4. On the contrary, the externally let-off rope 28 obtained through the rope let-off hole 11, with the rope wound around the large-diameter drum 7, is inserted into the rope insertion hole 21 via the rope insertion hole 19 and further into the rope insertion hole 20 and is then drawn out to the outside through an opening formed in an outside wall of the rope insertion hole 20, so that a hanging-down condition of the rope is obtained.

Figure 4:
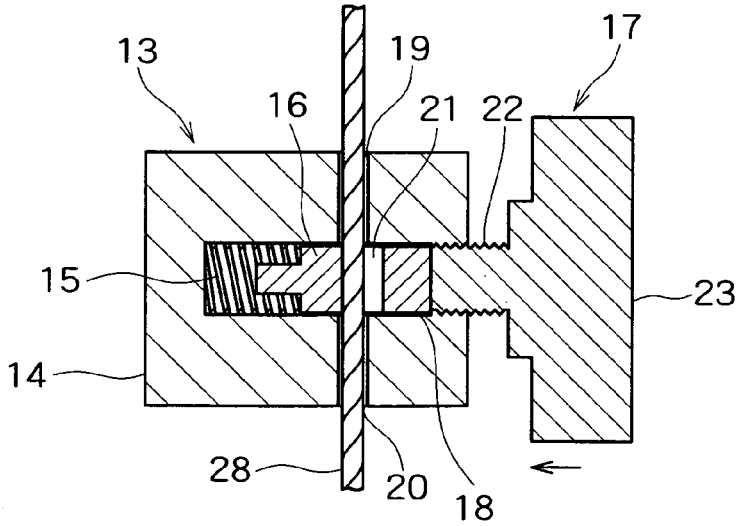
FIG. 4 illustrates a condition in which a release of restriction on an adjusting tool is attained in the rope traveling stopping device.
Figure 6:
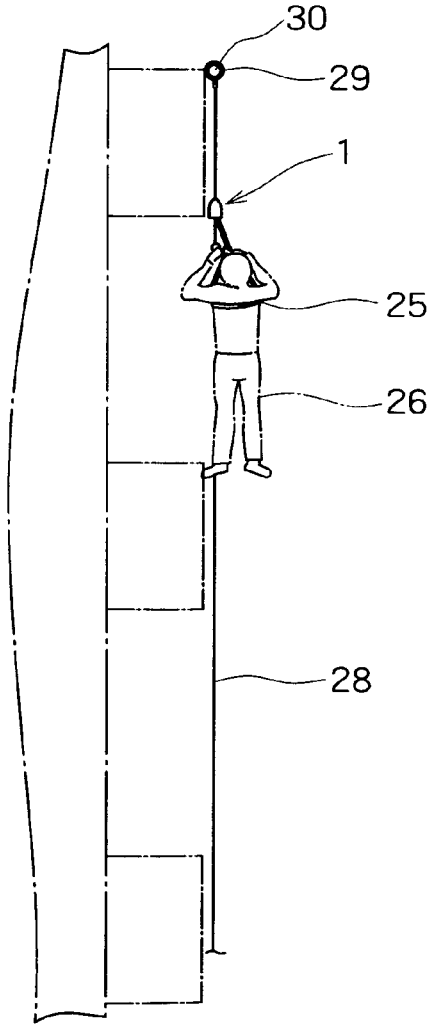
FIG. 6 illustrates a condition in which the escape device is at work.

An operation of the escape device according to the present invention will be described in the following. The user 26 carries out attaching of the hook 29 to an upstairs handrail 30 as shown in FIG. 1, and then encircles one's body with the belt 25. Then, fitting of the belt 25 to the body size of the user by positional adjustment with the clip 27 is effected, and the user 26 is then suspended in midair as shown in FIG. 6. A downward force acts on the belt 25 due to the weight of the user 26. Since the rope traveling stopping device 13 is connected to the belt 25, the operation of the handle 23 may be effected by the user 26 who is in a midair suspended condition. Firstly, as shown in FIG. 4, when relaxing of the handle 23 is effected, restriction obtained with the external thread 22 is released to move the adjusting tool 16 toward the opening within the cavity part 18 by the action of the energizing means 15 until the adjusting tool 16 reaches a position where the rope insertion holes 19, 21 and 20 are in alignment. When the adjusting tool 16 is in the above condition, a downward force that is about to cause descending by the weight of the user 26 acts on the speed decreasing gear 1 and the rope traveling stopping device 13. Also, an upward force acts on the rope 28 so as to cause the rope to be let off upwards through the rope let-off hole 10 of the housing 2. Also, a turning force acts on the small-diameter drum 4 so as to cause the small-diameter drum to be turned in the same direction as traveling of the rope 28. The small-diameter drum 4 and the gear 3 are adapted to effect synchronous turning. Thus, a turning force that is about to cause the gear 6 to be turned in the opposite direction to the gear 3 in engagement with the gear 3 acts on the gear 6, so that forces in opposite directions centering on an intermediate portion between the small-diameter drum 4 and the large-diameter drum 7 act on the rope 28. The weight of the user 26 is heavy enough to be effective in allowing the rope 28 to turn the small-diameter drum 4 and the gear 3 in the same direction as traveling of the rope 28 so as to let off the rope to the outside through the rope let-off hole 10, and in allowing the gear 6 to be turned while delaying a turning speed of the gear 3 by the action of the rope 28 wound around the large-diameter drum 7, so that the rope 28 wound around the large-diameter drum 7 travels toward the small-diameter drum 4 in such a manner as to slide on a peripheral surface of the large-diameter drum 7 against turning of the large-diameter drum 7. Accordingly, descending of the user 26 suspended with the belt 25 takes place slowly.

Figure 5:
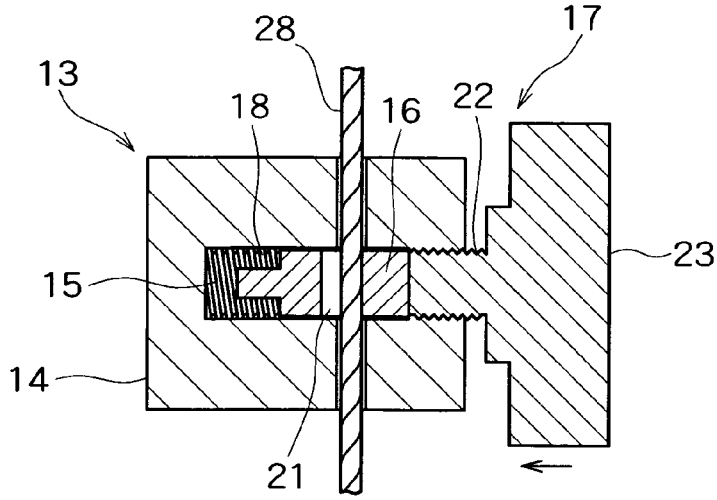
FIG. 5 illustrates a condition in which restriction is placed on the adjusting tool with a restricting means in the rope traveling stopping device.

When tightening of the handle 23 is effected to move the adjusting tool 16 in the opposite direction to the opening of the cavity part 18 with the external thread 22 as shown in FIG. 5, the adjusting tool 16 is returned to a fixed position by the action of the energizing means 15 and the restricting means 17. The rope 28 stops traveling in such a manner as to be sandwiched between an inner opening end of each of the rope insertion holes 19, 20 of the case 14 and an opening end of the rope insertion hole 21 of the adjusting tool 16. On the contrary, the speed decreasing gear 1 is in a condition where the turning force acts on the small-diameter drum 4 and the gear 3 so as to cause the rope 28 to be let off upwards, while the turning force acts on the gear 6 so as to cause the rope 28 to be let off downwards, as described above. When traveling of the rope 28 is brought to a stop with the rope traveling stopping device 13, the force acting on the speed decreasing gear 1 is reduced, so that the upward and downward forces acting on the rope 28 wound around the small-diameter drum 4 and the large-diameter drum 7 are balanced. As a result, the small-diameter drum 4 stops turning.

What is claimed is:

1. An emergency escaping device comprising:

a rope having one end provided with an attachment for attaching the rope to a building;

a gear box including a small-diameter drum and a large-diameter drum engaged with each other, wherein the rope is wound around the small-diameter drum and the large-diameter drum;

a rope-stopping device for restricting movement of the rope passing through the rope-stopping device; and a belt which interconnects the gear box and the rope-stopping device and which is configured to encircle the body of a user who can control speed of descent by operating the rope-stopping device.

2. The emergency escaping device according to claim 1, wherein the axis of the small-diameter drum and the axis of the large-diameter drum are disposed parallel to each other and perpendicular to the rope.

3. The emergency escaping device according to claim 2, wherein the small-diameter drum is disposed above the large-diameter drum.

4. The emergency escaping device according to claim 1, wherein the rope-stopping device has a cavity and a rope insertion hole which passes through the cavity, said rope-stopping device comprising a tightening device which is screwed into the cavity to press the rope passing through the rope insertion hole, thereby restring movement of the rope.

5. The emergency escaping device according to claim 4, wherein the tightening device has a handle wherein the user can tighten and lose the rope by turning the handle.

6. The emergency escaping device according to claim 1, wherein the belt has a length for encircling one person.

7. The emergency escaping device according to claim 1, wherein the rope has another end which is a loose end.

* * * * *